United States Patent [19]

Budrys et al.

[11] 4,109,246

[45] Aug. 22, 1978

[54] ALARM SYSTEM WITH REPEAT OF ALARM INTERRUPTED FOR PRIORITY ALARM

[75] Inventors: Ignas Budrys, Bethel; Robert W. Right, Huntington, both of Conn.

[73] Assignee: General Signal Corporation, Rochester, N.Y.

[21] Appl. No.: 700,939

[22] Filed: Jun. 29, 1976

[51] Int. Cl.[2] ..... G08B 19/00

[52] U.S. Cl. ..... 340/518; 340/147 LP; 340/524; 340/534

[58] Field of Search ..... 340/147 LP, 409, 413, 340/414

[56] References Cited

U.S. PATENT DOCUMENTS

| | | | |
|---|---|---|---|
| 2,995,729 | 8/1961 | Steele | 340/147 LP |
| 3,015,702 | 1/1962 | Vogel | 340/414 |
| 3,582,949 | 6/1971 | Forst | 340/414 |
| 3,818,447 | 6/1974 | Craft | 340/147 LP |
| 3,833,884 | 9/1974 | Bigbie | 340/147 LP |
| 3,940,739 | 2/1976 | Quimet | 340/413 |
| 3,985,217 | 10/1976 | Kortenhaus | 340/162 |

*Primary Examiner*—Harold I. Pitts
*Attorney, Agent, or Firm*—Milton E. Kleinman; George W. Killian

[57] ABSTRACT

A selected predetermined coded alarm is provided indicative of the one of a plurality of leads on which a signal indicative of an alarm condition may appear. If a station coded alarm should be initiated during the transmission of a coded alarm, the coded alarm is immediately terminated and the station coded alarm is given priority and transmitted immediately. Upon completion of the station coded alarm, the coded alarm being transmitted at the time of the receipt of the station coded alarm is transmitted with the new transmission starting at the start of its code irrespective of the status of the transmission at the time of the interruption. Appropriate delays are provided between codes and code elements. The plurality of leads are sequentially scanned, but once a transmitted code is transmitted, it is not retransmitted on a subsequent scan unless a reset signal has been provided. Each transmitted code is repeated a predetermined number of times. The specific code transmitted in response to a signal on any of the leads may be controlled by wiring options.

9 Claims, 1 Drawing Figure

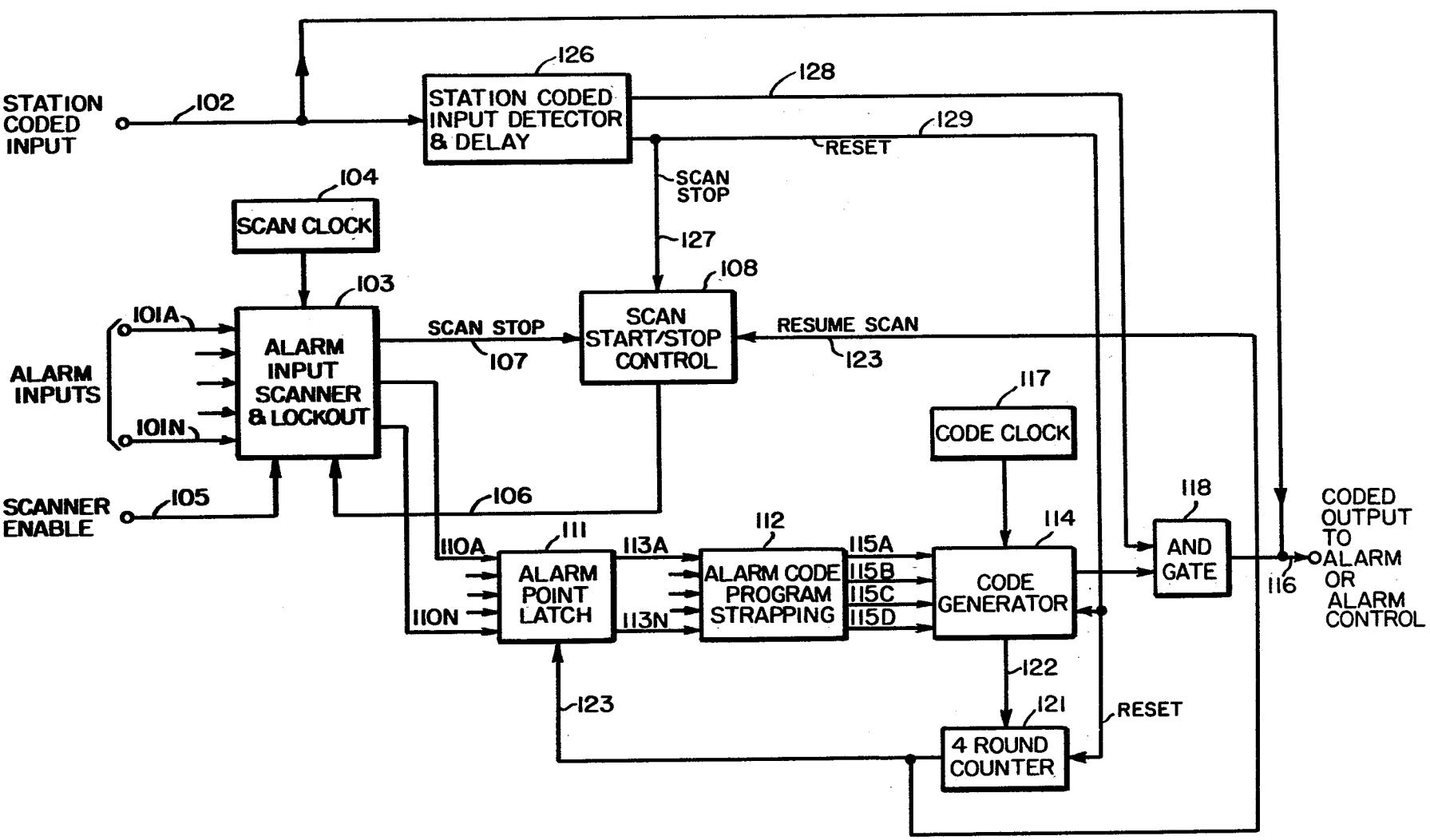
CODED OUTPUT TO ALARM OR ALARM CONTROL
116
118
AND GATE
RESET
117
CODE CLOCK
114
CODE GENERATOR
122
121
4 ROUND COUNTER
129
RESET
128
RESUME SCAN
123
115A
115B
115C
115D
112
ALARM CODE PROGRAM STRAPPING
108
SCAN START/STOP CONTROL
SCAN STOP
127
113A
113N
126
STATION CODED INPUT DETECTOR & DELAY
111
ALARM POINT LATCH
123
SCAN STOP
107
106
110A
110N
104
SCAN CLOCK
103
ALARM INPUT SCANNER & LOCKOUT
102
101A
101N
105
STATION CODED INPUT
ALARM INPUTS
SCANNER ENABLE

ALARM SYSTEM WITH REPEAT OF ALARM INTERRUPTED FOR PRIORITY ALARM

BACKGROUND OF THE INVENTION

1. Field of the Invention

This invention relates to an alarm annunciator and, more particularly, to a system for providing audible coded alarm signals indicative of the occurrence of certain nonstandard conditions. By way of illustration, the system might be used in a warehouse or factory to indicate various types of nonstandard conditions such as: Excessive heat; open flame; an open door or window; a water leak; movement in an area that should be uninhabited; a malfunctioning machine or process; or any of a wide variety of other conditions that should be made known and/or might require corrective action.

2. Description of the Prior Art

A wide variety of features have been provided in prior art systems. In some systems, the nonstandard condition responsive means includes a mechanical mechanism for generating a unique code which results in audible signals. In other systems, the nonstandard sensing means places a potential indicative of the nonstandard condition on a lead. In response to the presence of this potential, a unique code indicative of the nature and location of the nonstandard condition may be generated.

Systems of the first type may be defined as station coded alarm systems. In such systems, if two nonstandard conditions should develop simultaneously, a garbled and nonsense alarm code may be generated. This condition is particularly aggravated if common audible means are used.

Systems of the second type usually provide lockout means to prevent overlapping or garbled codes. Such systems may also include means for preventing retransmission of an alarm code without a reset signal and/or for locking in an alarm condition signal even though the nonstandard condition may have existed only momentarily.

Sometimes, it is desirable to be able to have a system which uses commom audible alarms and which uses sensing means which produce a station coded signal together with station means which apply a potential indicative of the nonstandard condition. In such systems, the receipt of a station coded alarm during the transmission of another alarm can result in garbled codes so that neither alarm code is intelligible.

SUMMARY OF THE INVENTION

The present invention provides for a combined system which minimizes garbled codes and guarantees accurate transmission of all codes irrespective of the sequence in which the nonstandard conditions are generated or when they may occur with respect to each other.

In the present system, a station coded alarm sensing means may be used in combination with any number of other alarm conditions represented by potential on their respective leads and using common audible alarm means. The station coded alarm is always given priority and will be transmitted immediately. If any other alarm is in progress, it will be terminated and the station coded alarm transmitted. This means that the initial transmission of the station coded alarm can immediately follow the transmitted part of an interrupted code and thereby produce a nonsense code. However, the mechanical apparatus for producing station coded alarms is normally arranged to produce the code either three or four times. Accordingly, although the first transmission may result in a nonsense code, there will be successive accurate transmissions of the station coded alarm.

The control apparatus includes means for storing information concerning the code being transmitted at the time the station coded alarm took priority. At the conclusion of the station coded alarm transmittal, the alarm previously being transmitted will be retransmitted beginning at the start of its code irrespective of what portion of the code had been transmitted at the time the station coded alarm took priority.

The present alarm annunciator responds to signals indicative of predetermined nonstandard condition on any one or more of a plurality of leads and activates a code generator to generate a unique code indicative of the one of the plurality of leads on which the signal was received. The code then represents an indication of the nature and location of the nonstandard condition. Priority means are provided for responding to a signal on a station coded input lead for terminating the generation of any code being generated in response to a signal on one of the plurality of leads and, subsequent to the termination of the station coded signal, transmission of the prior code is resumed. The resumed transmission is started from the start of the code and not from its point of interruption when the station coded alarm took priority. Timing and counting means are provided to assure appropriate intervals between transmissions of coded alarms, and elements thereof, and to limit the number of transmissions of each coded alarm. Lockout means are also provided for preventing the transmission of an already transmitted alarm until such time as a reset signal is given and the alarm condition occurs again.

It is an object of this invention to provide a new and improved audible annunciator.

It is another object of this invention to provide a new and improved coded alarm annunciator which uses common audible alarm means for a plurality of alarm conditions.

It is another object of this invention to provide an audible alarm annunciator which provides signals in response to potentials on one or more of a plurality of leads and which gives priority to an alarm from a station coded device.

It is another object of the invention to terminate any alarm being transmitted in favor of a signal from a station coded device.

It is another object of the invention to resume sounding a previously initiated coded alarm subsequent to the transmission of a station coded alarm and to do so at the start of an alarm code.

It is another object of the invention to lockout an alarm signal once it has been transmitted and until a reset signal is applied.

BRIEF DESCRIPTION OF THE DRAWING

These objects, together with other objects, advantages and features of the invention, will be more fully appreciated as the following description is considered together with the drawing which represents a block diagram of the system.

DESCRIPTION OF THE PREFERRED EMBODIMENT

While the circuit of the present invention could be implemented with a wide variety of components, it is contemplated that integrated circuits would be used in order to provide a more compact unit. Suitable COS/-MOS integrated circuits are manufactured by various corporations and systems may be built by employing integrated circuits having a wide variety of gates, mulivibrators, flip flops, latches, shift registers, counters, oscillators, amplifiers, clocks, and/or allied and associated elements. The characteristics and features of suitable integrated circuits are well documented in manufacturers handbooks such as the RCA COS/MOS digital integrated circuits handbook SSD-203C of 1975. Accordingly, circuit details of such integrated circuits are not shown, as such showing would only tend to add unnecessary detail to the drawing and obscure the interrelationship of the various building blocks and the invention.

Considering now more specifically the block diagram of the invention, there will be seen a plurality of alarm input leads which are desigated 101A to 101N. The actual number of alarm input leads will depend on a wide variety of factors including, but not limited to, the types of alarms or nonstandard conditions which it is desired to supervise, the number of stations being supervised, the probable relative frequency of alarm conditions, and a variety of other factors which those familiar with the design and installation of alarm systems are aware. As a practical matter, the number of alarm leads 101 will, in many installations, be limited to approximately one dozen. An alarm condition may comprise any of a wide variety of nonstandard conditions such as: Excess heat; open flame; excess moisture; movement in an area that should be uninhabited; temperature outside acceptable limits; opened or unlocked passageways; power failure; and/or any of a wide variety of other conditions which may be sensed by various sensing devices or transducers. Typically, such sensing devices or transducers will, when activated, place a system ground on the associated lead 101A–101N. As will be seen, such ground will result in the generation of a coded audible alarm which will comprise a plural group of plural sounds. For example, each code may comprise four elements with each element comprising from one to nine separate bursts of sound. Each burst of sound will be separated from each other burst of sound by a brief but uniform time interval. In like manner, each element comprising a plural burst of sounds will be separated from each other element by a longer time interval. Each code is usually repeated about four times in order to give those who hear it an opportunity to count the bursts of sound in each element and verify proper code interpretation. Each code repetition is separated by an interval of time which is longer than the interval of time between the various elements of the code. A typical code might be two, three, two, three. This would result in a first burst of sound, a brief interval followed by a second burst of sound. These two sounds would comprise the first code element, namely two. After a fixed interval of time to separate the various code elements and which is a little longer than the time interval between successive bursts, the second code element, three, would be sounded. In this case, the second code element would comprise three bursts of sound with each burst separated from the adjacent burst by the same time interval used in the first code element. The second code element would be followed by the third code element after a suitable interval of time corresponding to the time between the first and second code element. And so on through the fourth code element. After a suitable interval of time, which will be appreciably longer than the interval of time between successive code elements, the entire code will be repeated. As stated, it is normal to repeat a code four times. A typical burst rate is two bursts per second.

It will be obvious that instead of sounding a coded alarm, it would be a simple matter to flash lights an equivalent number of times. Also, it will be obvious that, should circumstances require, it would be a simple matter to cause the system to illuminate numbers indicative of the alarm code.

Certain alarm sensing devices include electromechanical or mechanical means for the direct transmission of a code indicative of predetermined factors relating to the alarm condition. Typically, such devices may be thought of as a contact actuated by a coded cam which actuates the contact in a predetermined manner, a predetermined number of times, and with predetermined intervals between each actuation. Such a sensing device is said to have a station coded input. That is, the code to be transmitted is determined at the station, and not, in the manner to be described more fully in connection with a system ground, on one of the leads 101A to 101N. Lead 102 represents a station coded input lead. A station coded signal is generated at the station by mechanical means and cannot be repeated or recalled except as provided for by the mechanism. This usually requires a manual reset. Accordingly, any alarm originating from a station coded sensor must be given priority in order to avoid loss of the intelligence. Means for providing the required priority will be discussed more fully hereinbelow.

Alarm input scanner and lockout circuit 103 is driven by a scan clock 104. The alarm input scanner and lockout circuit 103 is enabled by a signal on the scanner enable lead 105, and the starting and stopping of the scanner 103 is controlled by the signal on the scan start/stop lead 106. Under normal operating conditions, the scanner 103 will be enabled by a signal on lead 105 and the scanner 103 will scan the leads 101A to 101N at a rate determined by the scan clock 104 when an appropriate signal is on lead 106. Scanning the leads 101A through 101N means that each one is examined sequentially to determine if a system ground has been placed thereon. As soon as one of the leads 101A to 101N is found to have a system ground thereon, a signal is sent from the alarm input scanner and lockout circuit 103 on the scan stop pulse lead 107 to advise the scan start/stop control circuit 108 to remove the signal from the scan start/stop lead 106 and terminate the scanning.

The alarm imput scanner and lockout circuit 103 has a plurality of output leads 110A to 110N which correspond in number to the input leads 101A to 101N. A system ground on one of the alarm input leads 101A to 101N will result in an output signal on the corresponding one of the output leads 110A to 110N. A signal on one of the output leads 110A to 110N will be applied to the alarm point latch 111 which in turn is coupled to the alarm code program strapping circuit 112 by leads 113A to 113N.

Program strapping in the alarm code circuit 112 determines the specific coded audible alarm that it is desired to have sounded in response to a system ground on any specific one of the leads 101A to 101N. Any one of the alarm inputs 101A to 101N may be caused to sound a coded audible alarm of four elements with each element comprising one to nine burst of sound. Of course, more or less than four elements could be used if desired;

and more or less than nine bursts could be used in each element. A typical alarm code may be defined by four numbers with each number representing the number of sound bursts in each element. Thus, with the suggested limits, the codes could range from 1, 1, 1, 1 to 9, 9, 9, 9. Appropriate code information is transmitted from the alarm code circuit 112 to the code generator 114 on leads 115A, 115B, 115C and 115D. The code generator 114 produces an output signal which passes through enabled AND gate 118 to lead 116 which may directly actuate a sounding device such as a bell, horn, or siren or which may actuate a relay which in turn energizes one or more bells, horns, or sirens. A code clock 117 controls the intervals of time between the individual burst of each element; the somewhat longer intervals of time between successive elements and the still longer intervals of time between successive codes. A four round counter 121 is coupled to the code generator 114 by lead 122. The four round counter 121 counts the number of rounds or whole codes that have been generated and audibly transmitted. After four rounds have been transmitted, the four round counter provides a signal on lead 123 to the scan start/stop control circuit 108 which responds by providing a signal on lead 106 to activate the alarm input scanner and lockout circuit 103 to resume the scan of the leads 101A to 101N under control of the scan clock 104. As indicated, the alarm input scanner and lockout circuit 103 includes a lockout which will cause the scanner to pass over any one of the leads 101A to 101N which has already had a system ground detected thereon. By this lockout means, the repetitive sounding of the same alarm is avoided. The signal from the four round counter 121 on lead 123 is also applied to the alarm point latch 111 to prepare it for reception of another signal on any one of the other leads 110A to 110N.

The system may be reset so that it will again respond to a new alarm condition on any one of the leads 101A to 101N that had previously activated the audible alarm by interrupting and replacing the scanner enable potential on lead 105.

If system ground potentials should appear on two or more of the alarm inputs 101A to 101N at the same time, their respective codes will be sounded sequentially. That is, the first one of the alarm input leads to be interrogated by the scanner will cause the appropriate audible alarm to be sounded in the manner described above. Then, after a fixed time delay, the scanner will resume scanning and the other alarm will be sounded. The alarm input scanner and lockout circuit 103 may be arranged to lock in the fact that an alarm input has appeared on any one of the leads 101A to 101N irrespective of whether or not the system ground potential remains thereon. The mentioned fixed time delay is greater than the delay between elements. This fixed time delay separates and distinguishes different codes.

It will be observed that the code clock 117 provides for a first uniform time interval between each burst of sound in a code element and a second uniform interval of time between successive code elements, and a third uniform increment of time between successive codes, or rounds. Thus, the interval of time between successive code elements is identical irrespective of whether or not the elements comprise a single audible burst or up to nine audible bursts. This provides more uniform sounding codes which are easier to count and derive the intelligence therefrom.

Consideration will now be given to the circuit actuation which takes place in response to a station coded input on lead 102. As soon as a station coded input is received on lead 102, it will be applied to the station coded input detector and delay circuit 126 which immediately produces a stop scan signal on lead 127. The stop scan signal on lead 127 influences the scan start/stop control circuit 108 which will produce a stop scan signal on lead 106 to terminate scanning in the alarm input scanner and lockout circuit 103. In addition, the station coded input detector and delay circuit applies a signal on lead 128 to turn off AND gate 118 and thereby prevent the passage of any code signals from code generator 114 through AND gate 118. When there is no alarm on lead 102, the lead 128 has an enabling potential thereon which enables AND gate 118 and permits codes from code generator 114 to be passed to lead 116. As soon as an alarm code appears on lead 102, the enabling potential to AND gate 118 is removed. Thus, the signal on led 128 immediately terminates the broadcasting of any audible alarm in progress at the time a station coded input is received on lead 102. The station coded signal on lead 102 is applied directly to the output code lead 116 to actuate the audible alarm apparatus. Accordingly, it will be seen that a station coded signal has priority over alarm signals originating from any other source. The station coded input signal is mechanically produced at the point of origin. The station coded input detector and delay circuit 126 monitors the input lead 102, and after a suitable interval subsequent to the termination of the coded signal on lead 102, the enabling potential is reapplied to lead 128 to enable AND gate 118. The signal previously applied to lead 127 to terminate scanning was also applied to lead 129 to reset the code generator 114 and the four round counter 121. If the alarm input scanner and lockout circuit 103 was in the scanning mode at the time the station coded signal was received on line 102, the alarm input scanner and lockout circuit 103 will resume scanning the leads 101A to 101N looking for one with a system ground indicative of an alarm condition. If, at the time the station coded signal appeared on lead 102, an alarm condition had existed on one of the leads 101A to 101N and the full four rounds of the alarm had not been broadcast, the alarm will be re-initiated and four complete rounds broadcast. That is, the alarm input scanner and lockout circuit 103 has locked in the alarm condition and it will be transmitted through the alarm point latch 111 and the alarm code program strapping circuit 112 to the code generator 114 for passage through the AND gate 118 to the coded output alarm 116. The rounds will be counted by the four round counter 121 and the broadcast terminated after the broadcasting of four rounds. If it were desired to provide unlimited repetition of the code, until a manual reset has been actuated, the round counter 121 could be eliminated or bypassed with optional wiring.

The delay interval built into the station coded input detector and delay circuit 126 may have any desired duration. In a practical application, a delay of approximately one quarter of a minute is appropriate. That is, for a period of approximately one quarter of one minute after the station coded input signal has been removed from lead 102, the station coded input detector and delay circuit will not apply an enabling potential to lead 128 to enable AND gate 118. This provides a suitable interval between individual codes so that when another code starts, the listener will be aware that it is a new code and not another round of the previous code. The delay interval built into the station coded input detector and delay 126 is slightly longer than the longest between-round interval (shortest code) of the station coded input device.

The scanner portion of the alarm input scanner and lockout circuit 103 may comprise a shift register such as the RCA COS/MOS integrated circuit CD4015. The alarm input and lockout portion may include NAND gates CD4011 and OR gates 4071. The alarm point latch 111 may be conveniently made of NOR gates 4001 and the alarm coding circuit 112 may include bilateral switches such as 4016 and decade counter/divider 4017. The round counter 121 may include a binary counter 4024.

If desired, more than one station coded device may be connected to lead 102. However, if two station coded devices attempt to provide alarms concurrently, the alarm will be garbled unless they are mechanically or electrically interlocked so that a second station coded device cannot initiate an alarm while another station coded device is transmitting an alarm.

A system reset may be provided by momentary interruption of the potential on the scanner enable lead 105 or by disconnection and reconnection of the power supply.

A scan rate of about one per second may be used to avoid interpretation of a line transient as an alarm condition.

While there has been shown and described what is considered at the present to be the preferred embodiment of the invention, modifications, thereto will readily occur to those skilled in the related arts. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

What is claimed is:

1. An alarm annunciator for responding to signals indicative of predetermined conditions on any one of a plurality of alarm input leads and for activating a code generator to generate a unique code indicative of the one of the plurality of alarm input leads on which the signal was received and comprising in combination:

(a) a station coded input lead coupled to said alarm annunciator and on which a distinctive code signal is transmitted for a limited period of time in response to a predetermined nonstandard condition;

(b) priority means responsive to the initiation of transmission of said distinctive code signal on said station coded input lead for terminating the generation of any unique code being generated in response to a signal on any one of said plurality of alarm input leads and for transmitting the distinctive code signal received on said station coded input lead; and (c) control means coupled to said priority means and responsive to the conclusion of the transmission of said distinctive code signal received on said station coded input lead for initiating the resumption of the unique code terminated in response to the initiation of said distinctive code signal on said station coded input lead irrespective of the then current status of said nonstandard condition.

2. The combination as set forth in claim 1, wherein said control means resets said code generator to cause the resumed code to be resumed at the start of its round rather than to continue from its point of termination by said priority means.

3. The combination as set forth in claim 2 and including a code clock coupled to said code generator for introducing first fixed intervals of time between elements of the unique code and for introducing second fixed intervals of time between rounds of the unique code.

4. The combination as set forth in claim 2 and including a round counter coupled to said code generator for counting the number of times the unique code is repeated and terminating the generation of said unique code after a predetermined number of rounds thereof.

5. The combination as set forth in claim 4, wherein said round counter is reset when said code generator is reset.

6. An alarm annunciator having a plurality of alarm inputs and a station coded input lead and comprising in combination:

(a) scanner means coupled to said plurality of alarm inputs for sequentially scanning said alarm inputs to determine if any have an alarm indicating potential thereon;

(b) code generating means coupled to said scanner and responsive to the determination that one of said alarm inputs has an alarm indicating potential thereon for generating a predetermined number of rounds of a unique code indicative of the specific one of said plurality of alarm inputs on which the alarm indicating potential was detected;

(c) a station input detector coupled to: said scanner means, said station coded input lead, and said code generating means, for terminating the operation of said scanner and terminating the generation of any unique code then in progress in response to receipt of a station coded signal on said station coded input lead; and (d) reset means coupled to said station coded input detector and said code generating means and responsive to the conclusion of a station coded signal for causing said code generating means to generate said predetermined number of rounds of any unique code terminated by said station coded input detector.

7. The combination as set forth in claim 6, and including timing means coupled to said coded input detector for delaying the effect of said reset means for a predetermined period of time subsequent to the termination of a station coded signal.

8. The combination as set forth in claim 7, wherein said scanner means is reactivated responsive to the elapse of said predetermined time period.

9. The combination as set forth in claim 6, wherein said code generating means includes program means for programming said code generator to produce a specific unique code from among a wide range of possible codes in response to an alarm indicating potential on an alarm input.

* * * * *